US007075458B2

(12) United States Patent
Dowdy

(10) Patent No.: US 7,075,458 B2
(45) Date of Patent: Jul. 11, 2006

(54) COLLISION AVOIDANCE METHOD AND SYSTEM

(76) Inventor: Paul Steven Dowdy, 704 Crestview, East Alton, IL (US) 62024

( * ) Notice: Subject to any disclaimer, the term of this patent is extended or adjusted under 35 U.S.C. 154(b) by 101 days.

(21) Appl. No.: 10/765,494

(22) Filed: Jan. 27, 2004

(65) Prior Publication Data

US 2005/0162262 A1 Jul. 28, 2005

(51) Int. Cl.
*G08B 23/00* (2006.01)

(52) U.S. Cl. ..... 340/984; 340/309.4; 340/691.3; 440/2

(58) Field of Classification Search ..... 340/984, 340/576, 309.16, 309.4, 691.3, 529; 180/272, 180/271; 701/21; 440/1, 2, 84
See application file for complete search history.

(56) References Cited

U.S. PATENT DOCUMENTS 3,106,981 A * 10/1963 Chakiris ..... 340/576
3,660,846 A 5/1972 Anderson
4,278,969 A * 7/1981 Woods ..... 340/576
4,611,199 A * 9/1986 Seko et al. ..... 340/576
4,759,731 A * 7/1988 Uchida et al. ..... 440/1
5,012,226 A * 4/1991 Love ..... 340/576
5,090,514 A * 2/1992 Wright ..... 180/271
5,392,030 A * 2/1995 Adams ..... 340/576
5,714,925 A * 2/1998 Lee et al. ..... 340/576
5,860,842 A * 1/1999 Parr ..... 441/80
6,469,664 B1 10/2002 Michaelson et al.
6,575,902 B1 6/2003 Burton

* cited by examiner

*Primary Examiner*—Thomas Mullen
(74) *Attorney, Agent, or Firm*—Hilgers, Bell & Richards LLP; Michael O. Scheinberg

(57) ABSTRACT

In one embodiment, a vehicular collision avoidance method is provided that includes monitoring a control of a vehicle and activating a first alarm if the control is not adjusted in a sufficient amount of time. The monitored control is normally and regularly adjusted by the vehicle's operator such that the time between adjustments is sufficiently smaller than the time normally needed to avoid a collision after it is detected that the control is no longer being controlled. The first alarm is activated if it is determined that the control is not adjusted in a sufficiently small amount of time from its preceding adjustment. Thus, the vehicle's operator or other vehicle member can react and take measures to ensure that the vehicle is under suitable control upon activation of the alarm and thereby avoid a possible collision.

25 Claims, 7 Drawing Sheets

COLLISION AVOIDANCE METHOD AND SYSTEM

TECHNICAL FIELD OF THE INVENTION

The present invention relates generally to a collision avoidance alarm system for a vehicle. In particular embodiments, it relates to an alarm apparatus for ensuring that a vehicle such as a tug is maintained under the control of its operator.

BACKGROUND

Barges are commonly used for conveying cargo over rivers, oceans and other waterways. They are an efficient solution for hauling materials because they can be connected together in sequence for carrying large cargo loads without requiring wide or deep waters. In addition, they can be pulled or pushed by a single tug, which makes them even more efficient. Unfortunately, however, because they are so large and propelled by a single tug, barges are susceptible to destructive collisions with objects such as bridges and piers because of their great momentum and limited maneuverability. In fact, on rivers for example, numerous accidents occur every year with some having disastrous consequences. Thus, it is vitally important that the tug operator (or pilot) continually be in control of the tug/barge combination while it is in motion.

Several solutions have been developed for avoiding accidents caused by negligent or incapacitated operators. For example, there has been developed an automatic collision warning system, as shown in U.S. Pat. No. 3,660,846, which operates in cooperation with a conventional radar system to automatically actuate an alarm system upon the location by the radar system of an object within a predetermined area. This then requires the operator of a ship or the like carrying the collision warning system to make some decision with regard to the located object. If, for example, the object is of no danger to the navigation of the ship, the operator may merely deactivate the alarm; however, if the object is on a collision course, the operator would take some evasive action. Unfortunately, however, this approach has several drawbacks especially with respect to barge tugs. While some tugs have radar systems, they are not typically suited for collision avoidance systems ("CAS") because of the tug's close proximity to common river structures such as buoys, piers, and the like. Moreover, for radar CAS systems to work well, they generally require straight "lines of sight" to potential obstacles, but rivers typically fail to satisfy this requirement with their bends and contours. In addition, the effectiveness of such an approach relies on the pilot taking appropriate action in response to a collision warning. It assumes that the pilot is viable and in control of the vessel, but if the pilot-is impaired or unconscious, it ceases to be effective. This is a major problem because many if not most barge accidents are caused by the pilot becoming incapacitated (e.g., falling asleep or blacking out from a medical condition).

To redress this problem, other systems monitor the pilot's physical state to ensure that the operator remains conscious and in control of the vehicle. Systems have been used that monitor physical attributes of the operator such as eye movement and posture to verify that the operator is awake and in control. For example, U.S. Pat. No. 6,575,902 to Burton discloses an operator vigilance monitoring system that includes means for gathering movement data associated with the operator. The movement gathering means includes sensors such as touch sensitive mats placed in locations of the vehicle that make contact with the driver, such as on the seat, steering wheel, pedal(s), seat belt or the like. Signals from the various sensors/mats are processed and analyzed by a processor, which is programmed to recognize particular movement signatures or patterns of movement, driver posture or profile and to interpret these to indicate that vigilance has deteriorated or is below an acceptable threshold. This solution may be effective, but it is complex and not convenient for operators such as tug pilots who are typically not confined to a specific position in the wheel house.

Accordingly, what is needed is an improved, efficient system and method for avoiding vehicle accidents that may be caused by an incapacitated or absent operator.

SUMMARY OF THE INVENTION

In one embodiment, a vehicular collision avoidance method is provided that includes monitoring a control of a vehicle and activating a first alarm if the control is not adjusted in a sufficient amount of time. The monitored control is normally and regularly adjusted by the vehicle's operator such that the time between adjustments is sufficiently smaller than the time normally needed to avoid a collision after it is detected that the control is no longer being controlled. The first alarm is activated if it is determined that the control is not adjusted in a sufficiently small amount of time from its preceding adjustment. Thus, the vehicle's operator or other vehicle member can react and take measures to ensure that the vehicle is under suitable control upon activation of the alarm and thereby avoid a possible collision.

In another embodiment, a collision avoidance system having a sensor and a timer is provided. The sensor monitors a vehicle control such as steering or some other control. The sensor provides a signal that is indicative of whether the control is adjusted. The timer is connected to the sensor to receive the provided signal and activates a first alarm if from the provided signal it determines that an excessive amount of time elapses without the control being adjusted.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes as the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, the following description is made with reference to the accompanying drawings, in which.

DETAILED DESCRIPTION

Collision avoidance systems discussed herein are based on the principle that certain vehicle controls are regularly adjusted by their operator or by an automated system under normal operation, and thus when the control ceases to be adjusted, one can assume that the vehicle is no longer under proper control. Collision avoidance systems of the present invention take advantage of this observation by monitoring one or more vehicle controls and sounding an alarm if it ceases to be adjusted.

While embodiments discussed herein are primarily directed to a barge tug, persons of skill will recognize that the invention may be applied to any type of vehicle such as ships, trucks, locomotives, and airplanes. It works especially well for vehicles operated by users over relatively long, monotonous trips, which makes them susceptible to falling asleep while in control of the vehicle. Similarly, with embodiments discussed herein, a tug's steering column is monitored as the vehicle control that is continually adjusted under normal operation. However, invention embodiments are certainly not limited to monitoring this control. Any vehicle control that is adjusted regularly enough under normal operation so that the failure of it to be adjusted can be detected soon enough to prevent an accident may be suitable for monitoring. Thus, any aspect of steering or some other parameter may be monitored for boats, wheeled vehicles, or aircraft.

Overview

Figure 1:
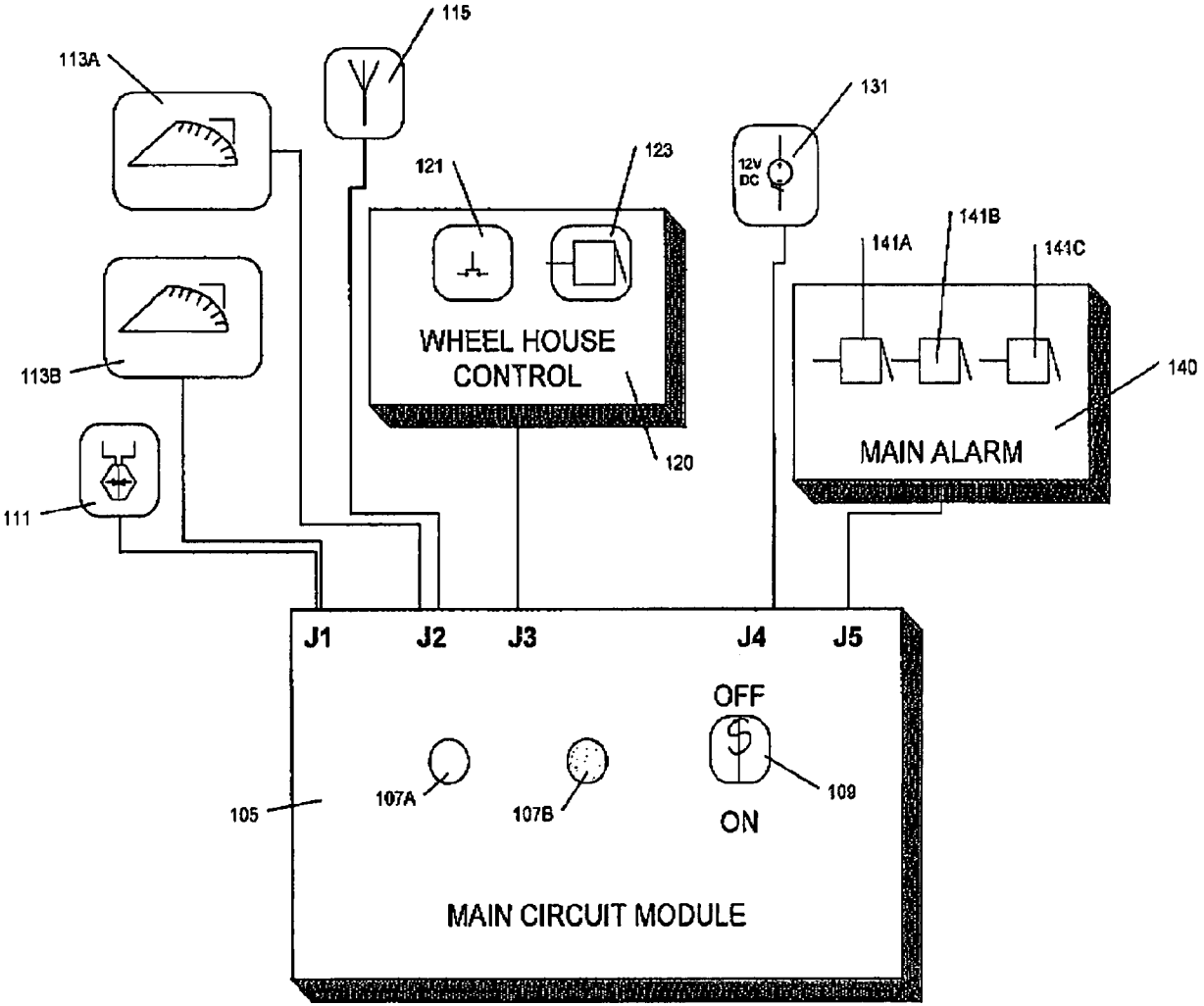
FIG. 1 is a modular diagram of one embodiment of a collision avoidance system of the present invention.

With reference to FIG. 1, one embodiment of a collision avoidance system for a river barge tug will be discussed on a functional, modular level. The depicted system generally includes a main circuit module 105, throttle switch 111, steering sensors 113A–B, remote disable switch 115, wheel house control module 120, DC source 131, and main alarm system 140. Module 105 includes a main circuit board (not shown and discussed below in greater detail with reference to FIGS. 3A–3H), along with main power switch 109, a first light emitting diode ("LED") 107A to indicate that system power is "on", and a second LED 107B to indicate that the sensors are sensing movement in the rudder steering system. Main circuit module 105 also includes board connectors, J1–J5, along with suitable cables or wires, for coupling the main circuit module 105 to the other system components. In particular, connector J1 couples main circuit module 105 to the first steering sensor 113A and to the throttle switch 111. Connector J2 couples main circuit module 105 to the second steering sensor 113B and to the remote disable switch 115. The wheel house control module 120 is connected to the main circuit module 105 through connector J3. It includes docking switch 121 and a first (or wheel house) alarm 123. Connector J4 connects DC power from the tug to the main circuit module 105, and J5 connects the main alarm module 140, which includes alarms 141A–C, to the main circuit module 105.

The main circuit module 105 is typically mounted in the tug's electronics room where it is connected to the tug's DC power source 131. First and second steering sensors 113A–B are mounted to the forward and flank rudder steering columns in the wheel house. Thus, when either rudder is adjusted by an operator (e.g., pilot), the sensor monitoring that rudder produces a signal indicating the adjustment and transmits it back to the main control module 105. The main circuit module 105 has first and second timers (not shown). The first timer is activated when the main power is turned on at switch 109 and when the throttle is engaged thereby opening the throttle switch 111, which serves to deactivate the timer unless the tug's throttle is engaged. This ensures that the alarms are not sounded unless the tug is actually moving. Once activated, the first timer "counts" for a "first-timer" set amount of time (e.g., 80 to 160 seconds) unless inhibited and reset by a signal received from one of the steering sensors 113A–B, indicating that the rudder has been moved, which causes the first timer to reset and start counting once again. If the first timer times out without receiving a signal from either sensor 113A/B, then it activates the first (wheel house) alarm 123, which is part of the wheel house control module 120 located in the wheel house of the tug. Upon hearing the alarm 123, the tug operator (or some other person in the wheel house) can then "acknowledge" the alarm by deactivating the alarm with remote deactivation switch 115, docking switch 121, or simply by making a steering adjustment. (If the operator is sleeping, this approach gives him a chance to "wake up" and regain control before an all out alarm from the main alarm system 140 is sounded.) The remote switch 115 resets the first timer, while the docking switch 121 actually disables it until either rudder is once again adjusted. The docking switch, as the name implies, is typically used when the boat is docked and thus the rudders are stationary.

If the first timer "times out," it activates the wheel house alarm 123 and initiates a second timer causing it to "count" for a second-timer preset amount of time (e.g., from 20 to 30 seconds). If the second timer is not deactivated (e.g., by the pilot with docking switch 121, a rudder adjustment, or by another person through deactivation switch 115), it will time out after its preset time period causing the main alarm system 140 to be activated thereby causing alarms 141A–C to activate. These alarms are typically mounted throughout the tug below the wheel house. Once they go off, the crew is alerted that the operator is likely not in control, and it will normally provide them with sufficient time to either disable the tug or to regain control in time to avoid a collision.

Figure 2:
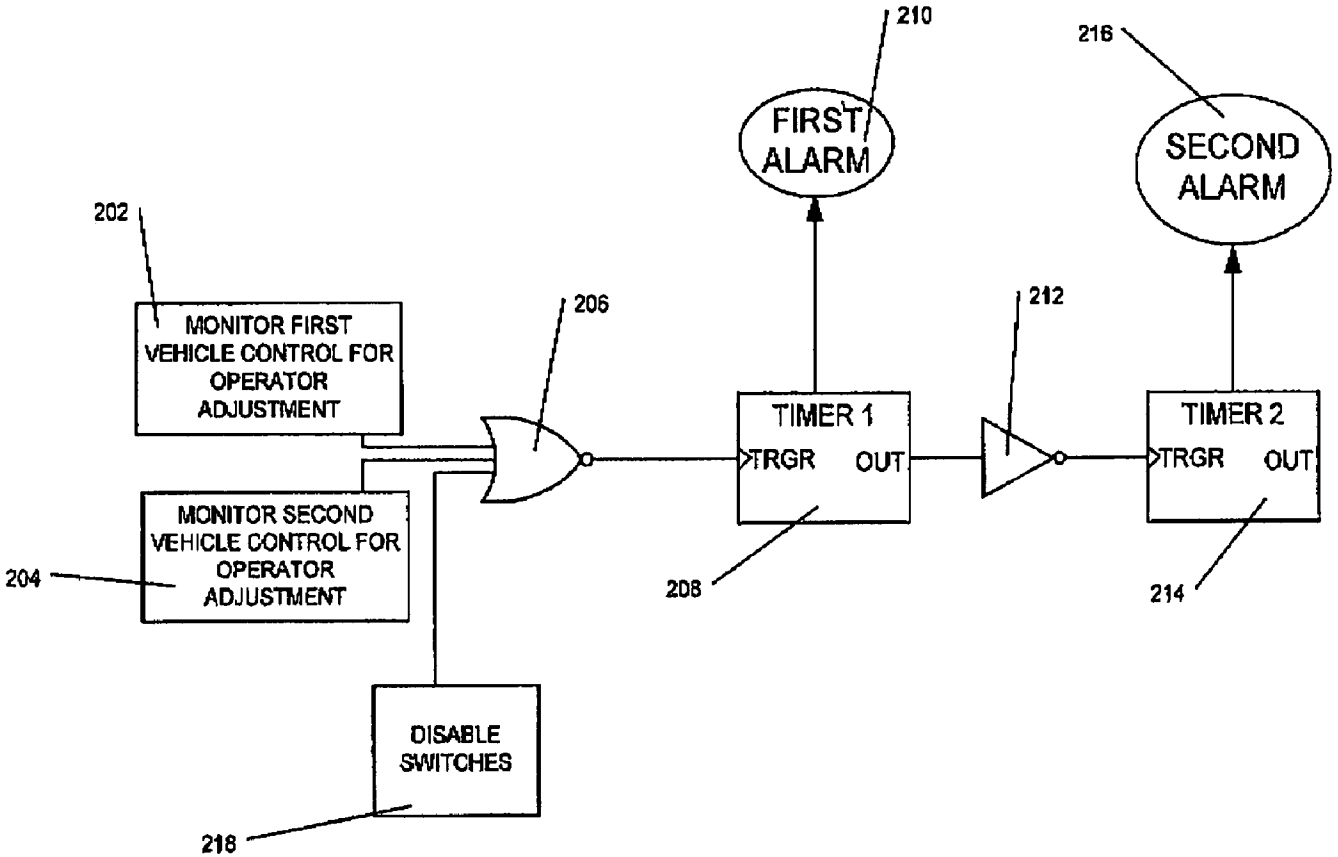
FIG. 2 is a logical block diagram of one embodiment of the collision avoidance system of FIG. 1.

FIG. 2 shows a logical block diagram of a collision avoidance system that is implemented with the system of FIG. 1 and with the circuits of FIGS. 3A–3I described below. (The description of this diagram is a good introduction to the circuits of FIGS. 3A–3I, which form an overall circuit that substantially performs the functions described with this diagram. However, it should be recognized that there are numerous ways to implement the functions and blocks described herein, and thus, the invention is not so limited.) The block system of FIG. 2 generally includes sensor blocks 202, 204, NOR gate 206, a first timer 208, a first alarm 210, an inverter 212, a second timer 214, a second alarm 216, and disable switches 218. The first sensor 202, second sensor 204, and disable switches 218 are each connected as inputs to the NOR gate 206, whose output is connected to the first timer block 208, which has an active Low input. Outputs of the first timer 208 are connected to the first alarm 210 and to the input of inverter 212, whose output is connected to the second timer 214 at its active low input. Finally, an output of the second timer 214 is connected to the second alarm 216. Upon receiving an active signal from either sensor 202, sensor 204, or a disable switch from switch block 218, NOR gate 206 applies a Low signal to the active Low input at the first timer 208. When this input is Low, the first timer 208 resets itself. Accordingly, the first timer 208 is not allowed to time out if repeatedly reset by one of the sensors 202/204 within the first timer's time period or if a disable switch provides it with an active signal. As long as the first timer 208 does not "time out," it provides at its output to inverter 212 a High signal causing the inverter to apply a Low signal at the active Low input of the second timer 214. As with the first timer, as long as this input is Low, it can not start counting (i.e., it is perpetually reset) and thus can not activate the second (and main) alarm 216. On the other hand, if upon being activated by the first timer 208 providing a Low at its output and causing the inverter 212 to input a High at the input of the second timer 214, the second timer 214 will "count" for its second timer set amount of time, and if it times out, it then activates the second alarm 216, which indicates an all-out alarm situation. In the next section, with reference to FIGS. 3A to 3I, a particular circuit is described for implementing this block system.

FIGS. 3A through 3I show schematic circuit views of the circuits for implementing the modules of FIGS. 1 and 2. FIGS. 3A–3C and 3H depict the circuitry within the main circuit module 105, while FIGS. 3D–3G and 3I depict the circuits in the remaining external components. These external component circuits will initially be described.

Figure 3A:
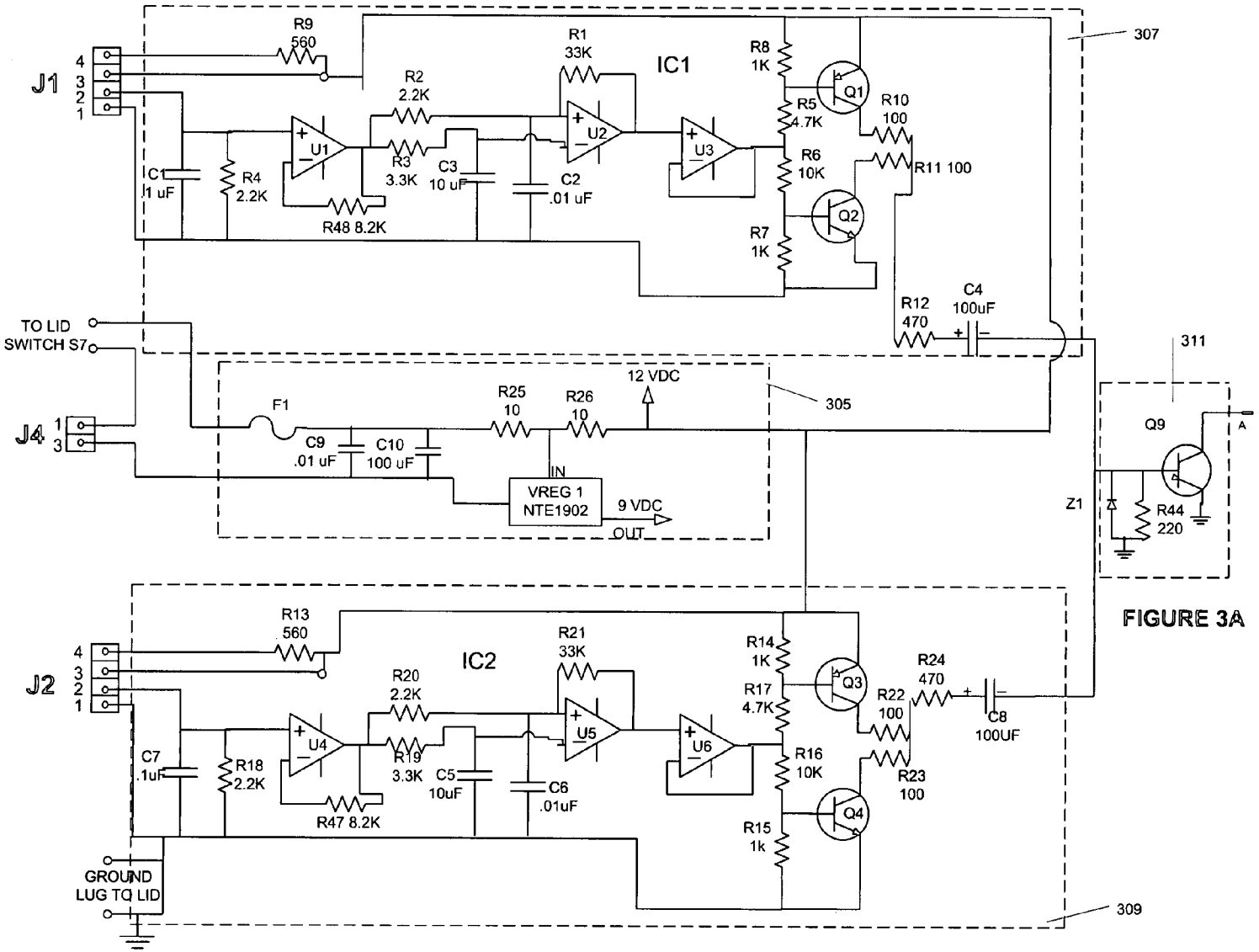
FIGS. 3A through 3I are schematic drawings of one embodiment of the collision avoidance system of FIGS. 1 and 2.
Figure 3B:
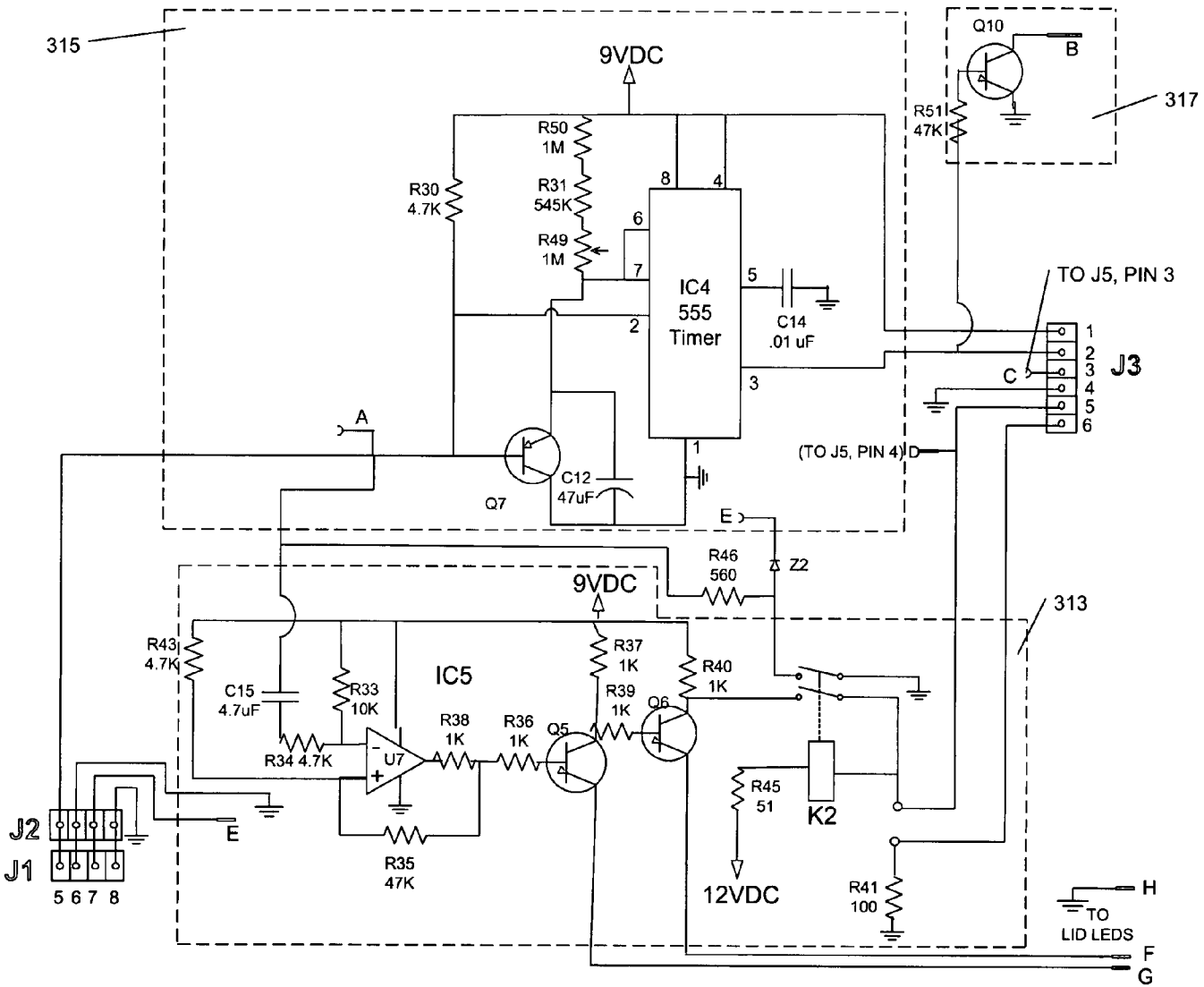
Figure 3C:
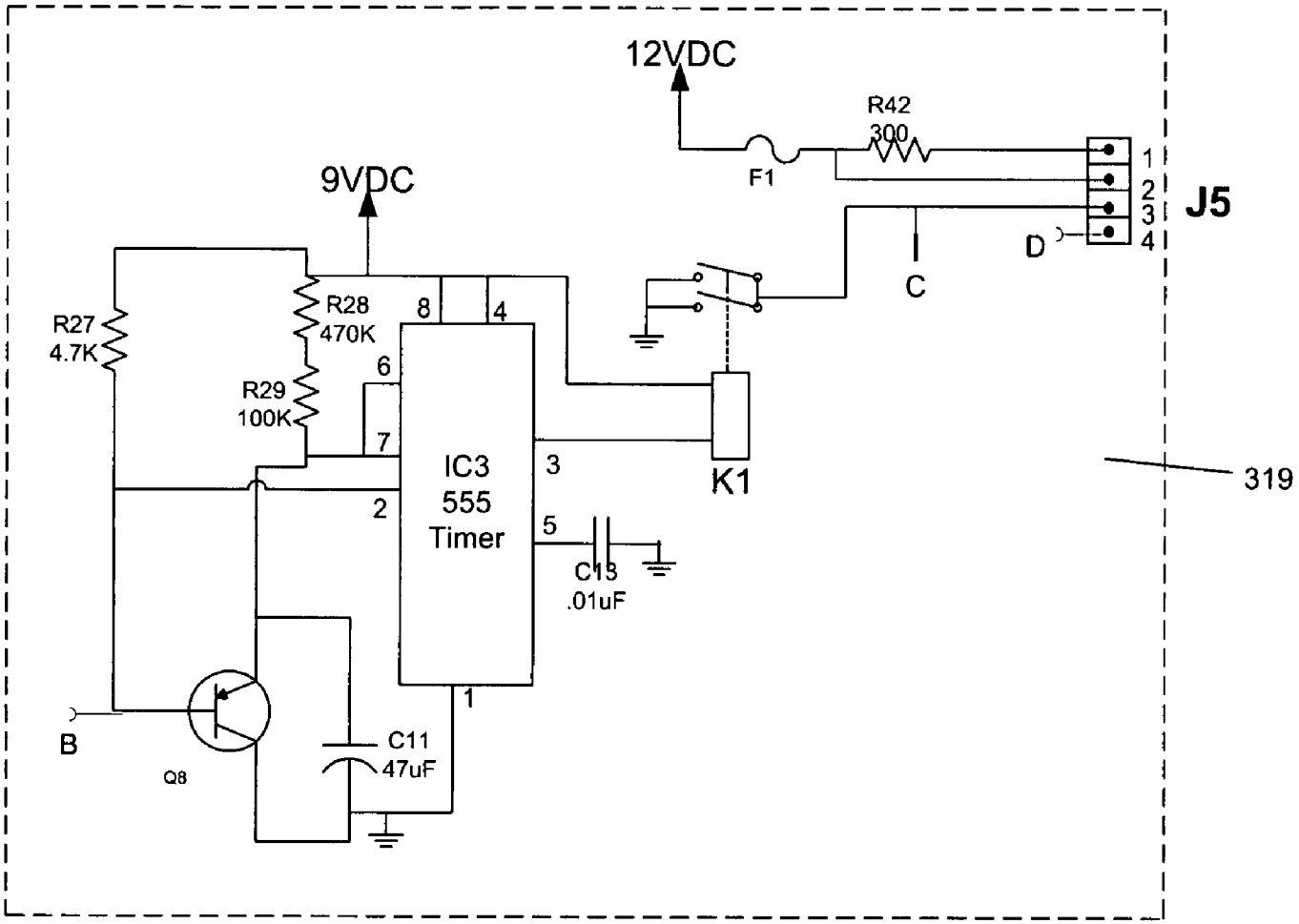
Figure 3G:
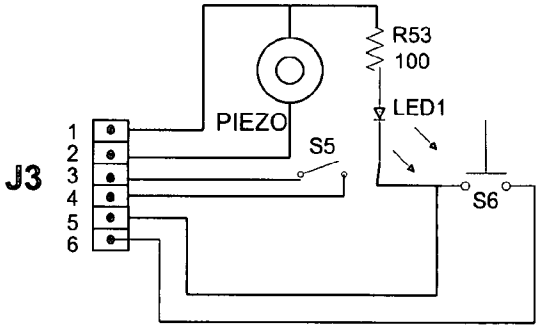
Figure 3H:
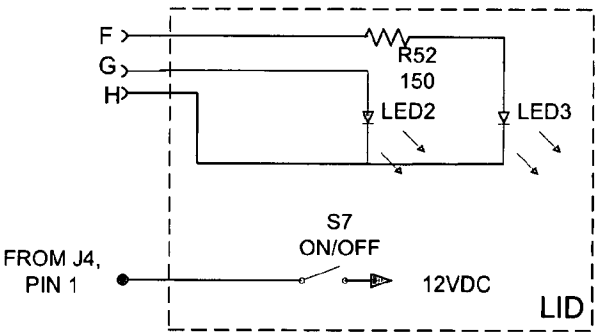
Figure 3I:
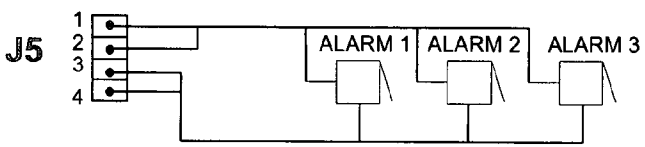
Figure 3D:
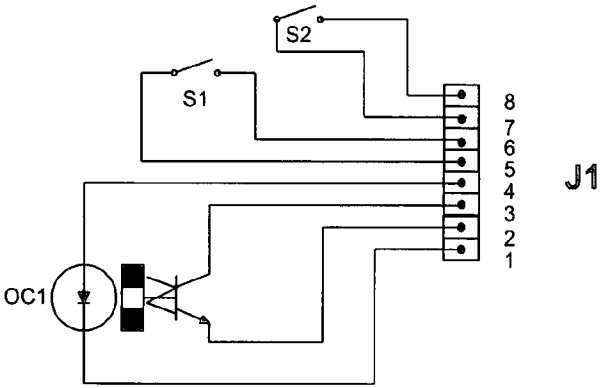
Figure 3E:
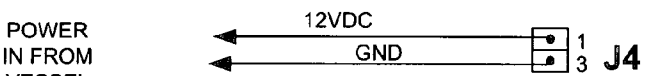
Figure 3F:
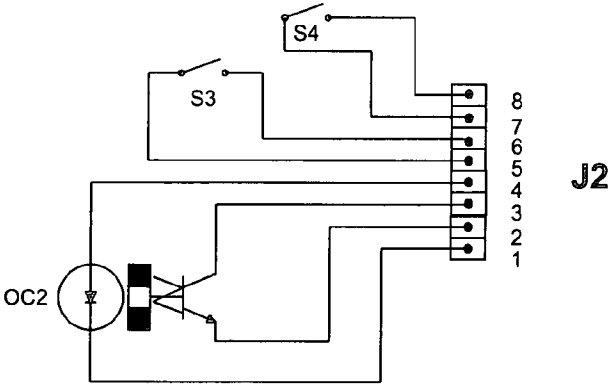

FIGS. 3D and 3F show circuits connected through connectors J1 and J2, respectively. They are equivalent circuits and are used to implement the first and second steering sensors, along with four deactivation switch functions. Because the circuits of FIGS. 3D and 3F are equivalent, only the circuit of FIG. 3D will be discussed since it also applies to the circuit of FIG. 3F. Connector J1 has 8 contacts; the first four contacts: 1–4 are connected to optical switch OC1, while contacts 5–8 are connected to disable switches S1 and S2. When the J1 connector is coupled with its counterpart J1 connector on the main circuit module, contacts 3 and 4 are connected to source voltages (12VDC) with contact 1 being connected to ground. Optical switch OC1 has a light source component that is turned on and connects between contacts 1 and 4. It also has an optically activated transistor switch portion that connects between contacts 3 and 2. Thus, when the transistor switch receives light from the light source portion, a potential is generated at pin 2, which serves as the signal output for OC1. As will be discussed in greater detail below with regard to FIGS. 4A and 4B, the optical switch OC1 is operably mounted about a slotted disk that in turn is fixed about a rudder steering column in the wheel house. The slotted portion of the disk is positioned between the optical switch's source and receiver such that when the steering column is rotated to steer the tug, the slots are passed between the source and receiver switch portion causing the receiver to receive rising and falling levels of light and producing a train of rounded pulses at the output of contact 2. It is worth pointing out that the circuit of FIG. 3F works the same way except that its optical switch, OC2, is mounted about a separate steering column for a different rudder such as a flank rudder. (In some tugs, both forward and flank rudders are used for separately steering a tug in both forward and reverse directions, respectively. By using two sensors for such tugs, steering can thereby be monitored regardless of the tug's direction. However, it is not necessary to monitor more than one control, and the invention is certainly not so limited.)

The deactivation switches S1, S2, S3, and S4 each work independently of each other for deactivating the first timer, but they all operate essentially the same way to perform a deactivation function. As will be further explained below, if any of the switches are closed, the first timer is forced into a perpetual reset state, which prevents it from timing out. These switches can each be implemented with any desired type of switch depending upon the tug environment and the needs of its crew. For example, in one embodiment, three of the four switches are implemented with a throttle switch, a hard-wired push-button switch, and an infra red ("IR") remote wireless switch. The throttle switch is part of the tug's throttle. When the throttle is engaged to propel the tug, the switch is open, but when the throttle is inactive, the switch is closed, which serves to deactivate the alarm system when the tug is not actually moving under power. The hard-wired switch is mounted in the wheel house but away from the wheel house console making it more convenient for the pilot to deactivate the alarm system if he/she is away from the helm. Similarly, the remote IR switch allows for the alarm system to be deactivated by a person anywhere on the tug within range of the remote switch receiver which, for example, could be mounted at J1 or J2 directly in the main circuit module 105 or in the wheel house at the wheel house module 120.

FIG. 3E shows connector J4, which is used to connect a 12VDC power source 131 from the tug to the main circuit module 105. As shown, contact 3 connects to ground, and contact 1 connects to the 12 Volt source.

FIG. 3G schematically shows the circuit in the wheel house module 120. It includes a piezoelectric buzzer labeled PIEZO connected between contacts 1 and 2. It also includes a test switch S5 connected to contacts 3 and 4, along with a push button docking switch, S6, connected between contacts 5 and 6 and a 100 Ohm resistor R3 connected in series with LED indicator LED1 between contacts 1 and 5. Functioning as the first (or wheel house alarm), the piezoelectric buzzer activates when contact 2 goes low, which occurs when the first timer (IC4 in FIG. 3B discussed below) times out. (This is so because when J3 is connected to its counterpart on the main circuit module, a 9 VDC supply is applied to contact 1.) Test switch S5 functions to test the main alarm system 140. When it is closed, it connects contacts 3 and 4 of connector J3, which causes an activating ground to be applied to the main alarm connector J5, contact J3 (see FIGS. 3C and 3I)causing the main alarm 140 to be sounded. Finally, when depressed, docking switch S6 causes the first timer to be deactivated until a steering sensor (OC1 or OC2) generates a pulse indicating that a steering adjustment has been made. It works by forcing a Low at the output of a bistable circuit 313 (FIG. 3B) discussed below, which deactivates the first timer. When the docking switch S6 is depressed and the first timer is deactivated, LED1 turns on thereby indicating that the alarm system is inactive.

FIG. 3H shows the circuit that is hard-wired in the lid of the main circuit module 105. It includes a main power on/off switch S7 connected between J4, contact 1 and a 12 VDC supply bus on the main circuit board (FIGS. 3A–3C) housed within the main circuit module 105. It also includes two LED lamps, LED2 and LED 3. Serving as a system on/off indicator, LED3 is connected between the main circuit 9VDC bus, R52, Q6 of the bistable circuit 313 (discussed below) and ground, which means that it is active whenever the main circuit module is turned on via the on/off switch S7 and when bistable transistor Q6 is turned on, which is normally the case except during a sensor pulse. In effect, it serves to indicate that the system is powered on. LED2 is connected between Q5 of the bistable circuit 313 (discussed below with FIG. 3B) and ground. This causes it to be activated anytime a steering sensor emits a pulse, which allows LED2 to function as an indicator confirming that the steering sensors and subsequent circuitry are functioning properly. When the tug is normally operated, LED2 will blink as either rudder is being adjusted.

With reference to FIGS. 3A–3C, the system's main circuit will now be described. The circuit can be broken down into several functional sections including a power supply section 305, a first steering sensor driver section 307, a second steering sensor driver section 309, a NOR gate section 311, bistable circuit 313, first timer circuit 315, inverter circuit 317, and second timer circuit 319. Each of these circuit sections (except for the second sensor driver 309, which is identical to the first sensor driver 307) will be discussed by describing their main components, inputs, and outputs but without necessarily addressing all of their parts, whose functions should be self-evident to persons of ordinary skill.

The power supply circuit section 305 provides the system with 12 VDC and 9VDC supply sources. It is provided with a 12VDC supply at its input on connector J4, contacts 1 and 3 through on/off switch S7 and fuse F1. It includes capacitors C9 and C10 for filtering the input 12 volt supply and a 9 volt DC regulator VREG1 (e.g., an NTE1902™ regulator) for providing the system with a 9 volt DC source.

The first and second steering sensor driver circuits 307 and 309, respectively, are substantially identical to one another and thus will not both be discussed except where pertinent. Only the first circuit section 307 will be addressed but the discussion applies equally to the second driver circuit 309. With reference to the upper left portion of circuit section 307, the first four contacts 1–4 of connector J1 connect to the optical switch steering sensor OP1 of FIG. 3A with contact 2 serving as the signal input to the driver circuit 307. Driver circuit 307 generally comprises four cascaded sub-sections: an input buffer stage amplifier formed from op amp U1, a differentiating and inverting amplifier formed from op amp U2, a buffer amplifier formed from U3, and an inverting output driver stage formed from transistors Q1 and Q2. (In the depicted embodiment, a single integrated circuit chip, IC1, with several LM324 operational amplifiers, is used to implement U1–U3, while Q1 and Q2 are implemented with 2N2906 and 2N2222 transistors, respectively.) When the rudder corresponding to the first steering sensor OC1 is adjusted, the sensor outputs to connector J1, contact 2 a train of rounded pulses, each varying between 0 and 12 volts, at the positive input of U1. The pulses are buffered by U1 and input to the differentiator circuit of U2 at its input resistors R2 and R3. This second stage not only flattens and widens out the pulses, but also it inverts them, and provides the inverted pulse to the input of the unity gain buffer of U3. At the output of U3, the inverted pulse is applied at the input of the inverting driver formed by Q1 and Q2, which provides at its output (at the commonly connected node of R10 and R11) an inversion of the inverted pulse, which results in a positive, buffered pulse being applied at the output of coupling capacitor C4. Again, the second sensor driver circuit 309 operates in the same way but with its output pulses applied through its coupling capacitor C8.

The outputs at coupling capacitors C4 and C8 are applied to the inputs of NOR circuit section 311, which is formed from transistor Q9 (a 2N2222 transistor), along with diode Z1 (a 1N4001 diode) and resistor R44. The diode and resistor combination at the input of Q9 prevent excessive negative spikes from impinging upon it. When a positive pulse from either C4 or C8 is applied to the input of Q9, a high to low pulse (e.g., from about 12 volts to about 0 to 2 volts) is provided at its output (labeled "A"), which in turn is input to the first timer 315 in FIG. 3B.

With reference to FIG. 3B, the first timer circuit 315 will now be described. The first timer circuit 315 is formed from IC4, which includes a conventional 555 timer circuit. The various resistors and capacitors are configured for timer IC4 to operate in a monostable mode. With this configuration, the input at pin 2 of timer IC4 serves as a trigger. Upon the negative edge of a High to Low pulse at pin 2, the timer resets causing a High value to be provided at its output at pin 3. As long as the input at pin 2 remains Low, the output at pin 3 will stay High, but if the input at pin 2 returns High, then the timer begins "counting" by charging capacitor C12. When it reaches a threshold level, the output goes Low. Thus, if a High-Low-High pulse is applied at input pin 2, a High pulse is output at pin 3 for a preset time duration. In the depicted circuit, the set timer period is equal to 1.1*(R31+R49+R50)*C12. R49 is a potentiometer, which allows the preset first timer period to be changed if desired. Thus, with the depicted values, the set timer period can range from about 94 to 120 seconds. Again, most of the depicted components in timer circuit 315 are conventionally arranged for monostable operation with their purposes being self evident, but it is worth pointing out that transistor Q7 (a 2N2906 transistor) functions to ensure that capacitor C12 is drained before it is charged when the timer is reset.

Under normal operation, one or more High-Low-High pulses is applied at the input pin 2 (which is the output from NOR circuit transistor Q9) when a rudder is adjusted. As long as either the first or second rudder is adjusted within the IC4 timer's set period (e.g., 100 seconds) from the last time it was adjusted, a High signal will remain at the output pin 3 of the timer. This output is connected to connector J3, contact 2, the low side of the wheel house PIEZO of FIG. 3G. Thus, as long as this output is High, the PIEZO remains inactive. On the other hand, if the timer times out (implying that neither rudder has been adjusted for the first timer period), then a low is output at pin 3, the low side of the PIEZO, which causes it to activate and create an alarm condition (e.g., loud noise) in the wheel house. Once this occurs, if the tug operator is not incapacitated, he/she can then deactivate it by closing one of the switches, S1, S2, S3, or S4 thereby causing a Low signal to be input at timer IC4, pin 2, either directly via J1/J2 (contacts 7 and 8) or indirectly via connector J1/J2 (contacts 5 and 6 through diode Z2 (a 1N4001 diode) and resistor R46). (Again, when a Low signal is applied to pin 2, the output at pin 3 stays High.) The operator could also deactivate the first timer by depressing the docking switch S6, whose operation will be discussed in the next paragraph in connection with bistable circuit 313. The output at pin 3 is also provided as the input to inverter 317, which comprises transistor Q10 and input base resistor R51. When the first timer outputs a non-alarm state High at its output, the output of Q10 is Low, which maintains the second timer (as discussed below) inactive. Conversely, when the output at pin 5 goes Low, the output at Q10 goes High causing the second timer to be activated and begin timing.

Bistable circuit 313 includes Op amp U7 (from IC5, which includes one or more conventional 714 op amps), transistors Q5, Q6 (2N2222 transistors), relay K2 (a Newark™ R40-11D2-12 DPDT 12V relay) and various resistors and capacitors as shown. The purpose of the bistable circuit 313 is to hold the first timer in a deactivated state when the docking switch S6 is depressed. Bistable circuit 313 has its output at the collector of transistor Q6 and an input at the upper side of coupling capacitor C15, this input being common to the first timer's input at pin 2. The bistable is configured such that when a High-Low-High pulse is received at its input, its output goes High, which ensures that relay K2 is inactive thereby leaving open the input to resistor R46 from relay K2's upper contacts. This allows the first timer to operate as discussed above. On the other hand, when docking switch S6 is depressed, contacts 5 and 6 of connector J3 are caused to temporarily come into contact with one another. This activates relay K2 by providing it with a ground through resistor R41, which closes the relay's lower contacts thereby latching K2 in the energized condition via collector output of the bistable at Q6. This causes the bistable to hold a Low at its output if and until it receives a Low pulse at its input (e.g., from one of the rudder steering driver circuits). The Low at its output keeps relay K2 in an active state, which maintains both of its contacts closed. With the upper contacts closed, a Low is applied to R46 and thus to the first timer's input at pin 2, which holds its output in an inactive High state at pin 3. Accordingly, docking switch S6 can be pressed to inactivate the tug (e.g., when the tug is docked in a port) and remains inactive until either of the tug's rudders is adjusted when it once again is on the move.

With reference to FIG. 3C, the second timer circuit 319 will now be discussed. It includes a 555 timer IC3, a relay K1 (R40-11D2-12 DPDT 12V relay), and various resistors, capacitors, and transistor Q8 (a 2N2906 transistor) configured for it to operate in a monostable mode equivalent to the first timer IC4. Its preset time period is equal to 1.1*(R28+R29)*C11. Thus, the depicted second timer circuit 319 has a preset time period of about 26.8 seconds. When the first timer times out with its output going Low, a High is applied at the output of Q10, which is input at pin 2 of the Second timer circuit timer IC3. This causes the second timer to begin timing, and if allowed to time out, a Low is applied at its output, pin 3, which activates relay K1. When K1 is activated, its contacts are closed, causing a ground to be applied at connector J5, contact 3, which as discussed above activates the main alarm system 140. Alternatively, if the first timer circuit 315 is inactive or is not timed out, it outputs a High, which results in a Low being applied at input 2 of the second timer IC3, which keeps it in an inactive state.

Steering Sensors

Figure 4B:
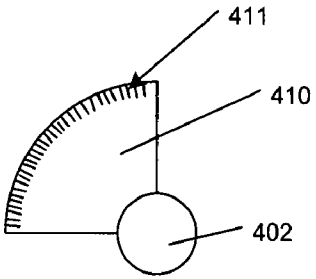
FIG. 4B is a top view of the slotted disk of FIG. 4A.
Figure 4A:
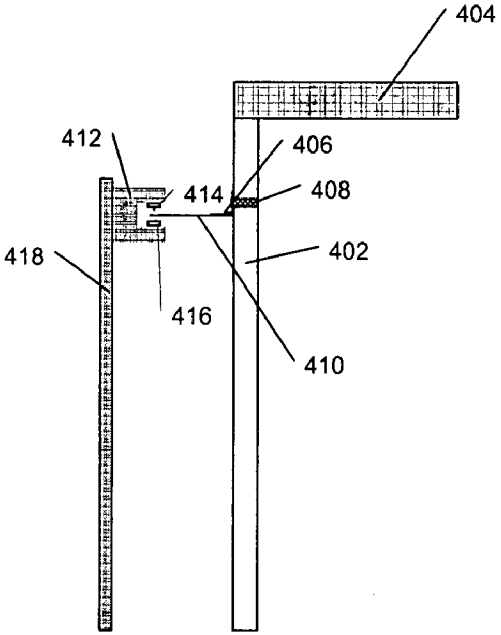
FIG. 4A is a side schematic view showing an optical switch operably mounted in cooperation with a slotted disk mounted about a steering column for monitoring the adjustment of a rudder.

With reference to FIGS. 4A and 4B, one embodiment of a steering sensor for a tug rudder steering system will now be discussed. The tug's steering system comprises a steering column 402 with a handle 404 for steering a rudder that is mechanically linked to the column 402. In this embodiment, the steering column 402 is located in the wheel house and has an exposed portion, which allows for the steering sensor to be operably mounted to it. Sensor 412 is mounted via mounting member 418, which is anchored to a suitable structure (such as the floor, floor beam, or console) sufficiently stable to avoid excessive vibration. In the depicted embodiment, sensor 412 is an optical switch sensor such as a Honeywell™ HOA1877-003 optical switch. Optical switch 412 includes a light source 414 and a light activated switch portion 416. Light source 414 and switch 416 portions are aligned with one another about a slotted disk portion 410, which is connected to the steering column 402 with bracket 406 and hinge clamp 408. As shown in FIG. 4B, slotted disk portion 410 is formed from a quarter section of a disk plate. In this embodiment, the disk plate is cut from an aluminum plate. At its periphery, it comprises a plurality of spaced apart slots 411 that are formed from cuts taken out of the disk until a desired number of slots with suitable widths, spacing, and lengths are formed. The sensor 412 is positioned about the disk periphery such that the light source 414 and switch 416 are aligned over and under the peripheral disk portion containing the slots 411. In this way, as the steering column 402 is rotated, the disk so to rotates causing the slots 411 to pass between the light source 414 and light activated switch 416 alternatively passing and blocking light thereby causing a rounded pulse to be produced by the sensor 412. In one embodiment, it was found that slots with widths of about 0.067", lengths of 0.375", and spaced apart from one another by about 0.067" worked well. The slots 411 should be close enough to result in a suitable signal being produced in response to a steering adjustment yet wide enough to limit the generation of false signals caused, e.g., by boat vibrations. The other disk dimensions should be considered along these lines based on the particular steering system and vehicle for which the sensor is being installed.

Figure 5:
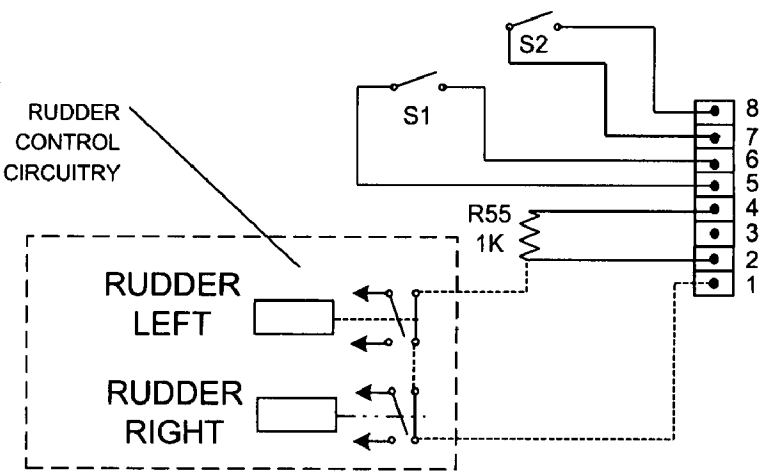
FIG. 5 schematically depicts a sensor implementation for an electrically activated rudder steering system.

FIG. 5 shows an alternative embodiment for a steering sensor. With this embodiment, the tug uses an electric actuated rudder steering system rather than a mechanical linkage such as that used in the system of FIGS. 4A and 4B. With the depicted hydraulic actuated system, a toggle switch (not shown) controls the rudder. When a left turn is initiated a "rudder left" relay is activated causing the hydraulics for the leftward rudder turn to be engaged. Likewise, a right turn command energizes a "rudder right" relay, which causes hydraulics for the rudder to be moved for a right turn to be activated. As seen in the figure, the particularly implemented relays each have a set of normally open and normally closed contacts. The normally open contacts are used for controlling the rudders, but the normally closed contacts are available for use as part of the steering sensor.

As shown, the normally closed contacts from each relay are connected together in series with each other between connector J1, contacts 1 and 2. In addition, a 1K pull-up resistor R55 is connected between connector J3, contacts 2 and 4. As with the embodiment of FIGS. 4A,B and FIG. 3A, contact 2 is used as the sensor output. When the rudder is not being adjusted, the normally closed contacts are closed, which applies a ground (or Low) at output contact 2. Conversely, when the rudder is being adjusted, one of the normally closed contacts opens, which causes the output at contact 2 to be pulled up to the 12 volt supply through resistor R55. Accordingly, a pulse is generated and applied to a sensor driver circuit substantially the same as with the mechanical steering sensor. Persons of skill will see that any suitable sensor design can be used depending upon the particular vehicle and particular steering mechanism that is used.

Other Embodiments

Although the present invention and its advantages have been described in detail, it should be understood that various changes, substitutions and alterations can be made herein without departing from the spirit and scope of the invention as defined by the appended claims.

For example, the invention is not limited to steering as the monitored control. Any control that is regularly adjusted such as braking or speed may be appropriate in certain circumstances, although steering may be preferable. Likewise, the invention is not limited to tugs but may be employed with other vehicles such as trucks, trains, ships, automobiles, and airplanes. In addition, while the primarily discussed embodiment is for a tug having two rudders, embodiments of the present invention are certainly not so limited. Tugs (and other boats) may have only one rudder or may have several rudders. It should be self-evident that designs described in this disclosure can be designed to work with only one steering sensor or with several steering sensors without departing from the principles presented herein. Furthermore, while the discussed circuits were implemented with discrete components and IC devices, any suitable combination of less or more discrete devices could be used. That is, the designs could be implemented without IC devices or could be implemented with higher level devices including microprocessors and/or micro controllers depending upon the particular needs and environment of the vehicle being monitored.

Accordingly, as one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Thus, the appended claims are intended to include within their scope such processes, machines, manufacture, compositions of matter, means, methods, or steps.

The invention claimed is:

1. A method for avoiding collisions of a ship having a rudder and a rudder control, comprising:

monitoring a rudder control of a ship, the rudder control normally being regularly adjusted by an operator, a time period beginning with an adjustment of the rudder control and ending with a subsequent adjustment, if any, to the rudder control defining an inactivity time period; and activating a first alarm if an inactivity time period is greater than a predetermined first time period, the predetermined first lime period being sufficiently short such that an appropriate party is alerted to take action to prevent a collision of the ship once the rudder has not been adjusted for the predetermined period.

2. The method of claim 1 further comprising sounding a second alarm if the inactivity time period is greater than a second time period.

3. The method of claim 2 wherein the first alarm is provided to the operator of the ship.

4. The method of claim 3, further comprising disabling the first alarm and continuing to monitor the control in response to a signal from the operator.

5. The method of claim 4, wherein the second alarm is provided externally to a ship operator compartment to allow the ship to be disabled by an entity other than the operator.

6. The method of claim 5, wherein the first alarm is provided in the pilot house of a tug.

7. The method of claim 6, wherein monitoring a rudder control of a ship includes monitoring the rudder of a tug.

8. A collision avoidance system for a ship having a rudder and a rudder control, comprising:

a sensor for monitoring a ship rudder control, the sensor providing a signal indicating when the ship rudder control is adjusted; and a first timer connected to said sensor to receive the provided signal, the timer activating a first alarm if from the provided signal it determines that an excessive amount of time elapses without the ship rudder control being adjusted.

9. The system of claim 8, wherein the ship is a tug, and the sensor is mounted to directly or indirectly monitor movement of a tug rudder.

10. The system of claim 9, wherein the sensor comprises a slotted disk mounted about a steering column and an optical switch operably positioned about the disk to generate a signal when the disk is rotated indicating that the steering column is being adjusted.

11. The system of claim 8, further comprising a second timer connected to the first timer, the second timer being activated in response to the first timer determining that an excessive amount of time elapsed without the control being adjusted, the second timer activating a second alarm if a preset amount of time elapses before the second timer is deactivated.

12. The system of claim 11, further comprising a docking switch connected to the first timer to disable said first timer upon activation by a user, the first timer remaining deactivated until the control is once again adjusted.

13. A collision avoidance system for a tug having a rudder and a steering system to control the rudder, comprising:

a sensor communicatively linked to the steering system for monitoring adjustment of the rudder, the sensor generating a signal indicative of whether the rudder is adjusted;

a first timer connected to said sensor to receive the generated signal, the first timer activating a first alarm if from the signal it is determined that a first preset amount of time elapses without the rudder being adjusted.

14. The system of claim 13, wherein the sensor comprises a slotted disk mounted about a steering column and an optical switch operably positioned about the disk to generate a signal when the disk is rotated indicating that the steering column is being adjusted.

15. The system of claim 13, wherein the sensor comprises a circuit integrated with a hydraulically actuated rudder control system.

16. The system of claim 13, further comprising a second timer connected to the first timer, the second timer being activated in response to the first timer determining that an excessive amount of time elapsed without the rudder being adjusted, the second timer activating a second alarm if a second preset amount of time elapses before the second timer is deactivated.

17. The system of claim 16, further comprising a docking switch connected to the first timer to disable said first timer upon activation by a user, the first timer remaining deactivated until the rudder is once again adjusted.

18. The system of claim 13, wherein the first alarm comprises a device for notifying an operator of the tug that an alarm condition exists, said first alarm device being mounted in a wheel house of the tug.

19. The system of claim 18, further comprising a second alarm mounted outside of the wheel house to notify crew members that an alarm condition exists if the first alarm is not deactivated within a preset amount of time.

20. A method for avoiding collisions of a ship having a rudder and a rudder control, comprising:

monitoring a rudder control of a ship, the rudder control normally being regularly adjusted by an operator, a time period beginning with an adjustment of the rudder control and ending with a subsequent operator action defining an inactivity tine period; and activating a first alarm if the inactivity time period is greater than a predetermined first time period, the predetermined first time period being sufficiently short that an appropriate party is alerted to take action to prevent a collision of the ship once the rudder has not been adjusted for the predetermined first time period.

21. The method of claim 20 in which the subsequent operator action includes a second adjustment of the rudder control.

22. The method of claim 20 in which the subsequent operator action includes disabling the alarm and continuing to monitor the rudder control.

23. A collision avoidance system for a tug having a steering system, comprising:

a sensor communicatively, linked to the steering system for monitoring adjustment of the steering system of the tug, the sensor generating a signal indicative of whether the steering system is adjusted; and a first timer connected to said sensor to receive the generated signal, the first timer activating a first alarm if from the signal it is determined that a first preset amount of time elapses without an operator taking an action.

24. The system of claim 23 in which the first timer activates the first alarm if from the signal it is determined that a first preset amount of time elapses without an operator adjusting the steering system.

25. The method of claim 23 in which the first timer activates the first alarm if from the signal it is determined that a first preset amount of time elapses without an operator disabling the alarm.

* * * * *